US006572676B1

(12) United States Patent
Kobayashi et al.

(10) Patent No.: US 6,572,676 B1
(45) Date of Patent: Jun. 3, 2003

(54) PROCESS FOR REFINING ALUMINUM

(75) Inventors: Hisashi Kobayashi, Putnam Valley; Arthur Francis Wellington, Monroe; Xueping Li, Somers; Jay Jonathan Feinstein, North Salem, all of NY (US)

(73) Assignee: Praxair Technology, Inc., Danbury, CT (US)

( * ) Notice: Subject to any disclaimer, the term of this patent is extended or adjusted under 35 U.S.C. 154(b) by 0 days.

(21) Appl. No.: 09/701,576

(22) PCT Filed: Jul. 12, 1999

(86) PCT No.: PCT/US99/15598

§ 371 (c)(1),
(2), (4) Date: Dec. 11, 2000

(87) PCT Pub. No.: WO00/03046

PCT Pub. Date: Jan. 20, 2000

Related U.S. Application Data

(60) Provisional application No. 60/092,539, filed on Jul. 13, 1998.

(51) Int. Cl.[7] ..... C22B 21/06

(52) U.S. Cl. ..... 75/680; 75/681; 75/686; 75/687

(58) Field of Search ..... 75/680, 681, 686, 75/687

(56) References Cited

U.S. PATENT DOCUMENTS

| | | | | |
|---|---|---|---|---|
| 4,353,532 A | | 10/1982 | Jay | 266/242 |
| 5,076,779 A | | 12/1991 | Kobayashi | 431/5 |
| 5,340,379 A | | 8/1994 | Tremblay et al. | 75/680 |
| 5,421,856 A | | 6/1995 | Lazcano-Navarro | 75/672 |
| 5,563,903 A | * | 10/1996 | Jebrail et al. | 75/672 |
| 5,609,481 A | | 3/1997 | Kobayashi | 432/22 |
| 5,961,689 A | * | 10/1999 | Kobayashi et al. | 75/414 |

FOREIGN PATENT DOCUMENTS

| | | | | |
|---|---|---|---|---|
| JP | 61-124540 A | * | 6/1986 | 75/685 |

* cited by examiner

*Primary Examiner*—Melvyn Andrews
(74) *Attorney, Agent, or Firm*—Donald T. Black

(57) ABSTRACT

A process for melting an aluminum charge into molten aluminum and simultaneously refining the molten aluminum to produce a refined molten aluminum having a low hydrogen content in a direct fired furnace (10) is provided.

11 Claims, 1 Drawing Sheet

Fig. 1
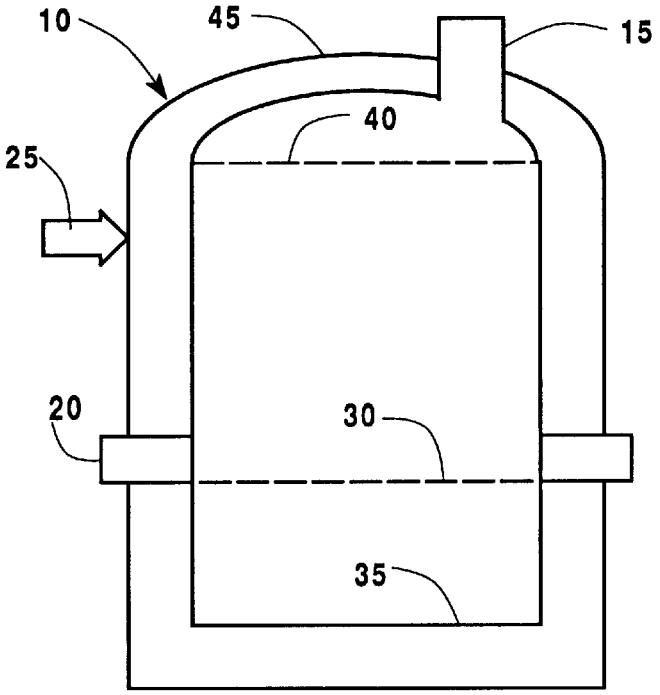
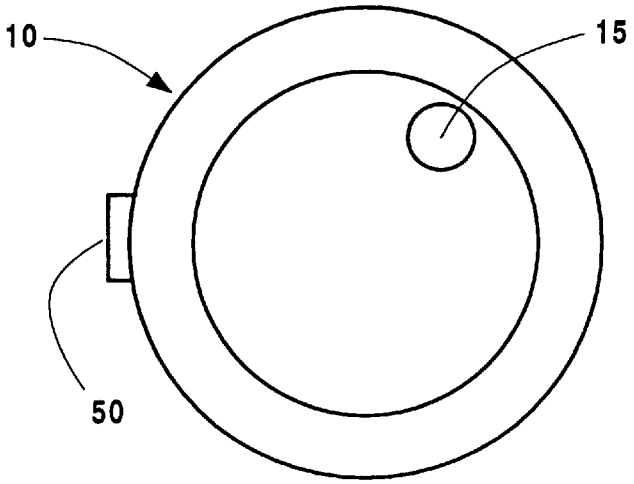
Fig. 2

PROCESS FOR REFINING ALUMINUM

This application is a 371 of PCT/US99/15598 filed Jul. 12, 1999 which claims benefit of U.S. Provisional Application No. 60/092,539 filed Jul. 13, 1998.

TECHNICAL FIELD

This invention relates generally to heating and/or melting, and refining a charge of aluminum in a direct fired furnace.

BACKGROUND ART

Using combustion to generate the heat for heating or melting a charge may have a deleterious effect on the charge. For example, oxidation of aluminum during direct heating results in the formation of dross. Another problem is that a significant amount of hydrogen is generated by the reactions of aluminum, water vapor and hydrocarbon species in the combustion flue gas. The hydrogen may dissolve into the molten charge, thus causing defects in the production of metal.

The prior art has addressed this problem to strip undesired gases by injecting an inert gas into the molten metal baths. This method may involve injecting nitrogen or argon through a submerged sparger to create a large number of small inert bubbles. The dissolved undesired gas diffuses into the inert gas bubbles and is then removed. This refining step is often conducted in a holding furnace where molten metal produced in a melting furnace is transferred and held prior to casting. When lower dissolved hydrogen contents are required, a special refining vessel is used to remove hydrogen more efficiently.

Those skilled in the art have addressed the problem of dross formation on the charge by providing a protective atmosphere over the charge surface between the furnace charge and the combustion reaction. The combustion gases are exhausted above the combustion reaction from the furnace so as to ensure that the combustion gases stay well removed from the charge surface. Important recent developments in this area are disclosed and claimed in U.S. Pat. No. 5,563,903 to Jebrail et al., U.S. Pat. No. 5,609,481 to Kobayashi and U.S. Pat. No. 5,961,689 all of which are incorporated herein by reference.

The '903 patent provides that conventional protective atmosphere heating arrangement has produced acceptable results when the height of the top surface of the charge is low relative to the burner height or when the charge is molten. However, relatively high levels of nitrogen oxides (NOx) generation is associated with this system. Moreover, the fuel and oxidant consumption is relatively high as is the potential corrosion of refractory. walls and burner parts within the furnace is concern.

The '481 patent provides for a direct-fired furnace wherein a charge-proximal stratum is established between the charge and combustion gases emanating from one or more burners oriented above the charge, wherein the protective atmosphere has a different oxidative effect upon the charge than does the combustion gases.

U.S. Ser. No. 09/033,608 discloses a method for providing heat to a large volume of furnace charge using combustion with a protective atmosphere therebetween, thus causing the reduced generation of NOx, using oxy-fuel combustion with a protective atmosphere therebetween, which enables the reduced consumption of fuel and oxidant as well as reducing the level of refractory corrosion.

There is no teaching or suggestion, however, for refining metal resulting from the presence of undesired gases during the process of simultaneously heating the metal and refinement therefor.

Accordingly, it is an object of this invention to provide a method for preventing undesired gases from dissolving into-molten metal and for removing dissolved undesired gases from the charge of a metal during melting of the charge in a direct fired furnace.

SUMMARY OF THE INVENTION

The above and other objectives, which will become apparent to those skilled in the art upon a reading of this disclosure, are attained by the present invention, one aspect of which is a process for producing molten aluminum having a low hydrogen content which comprises introducing an aluminum charge into a direct fired furnace to expose the charge to radiant heat emitted from above the charge; combusting a combustion mixture layer of fuel and oxidant to form a combustion layer which generates the radiant heat and combustion reaction products within the furnace; and introducing a hydrogen-free protective atmosphere into the furnace at a vertical distance below the combustion mixture layer. Also, a portion of a dissolved hydrogen-containing species from the molten aluminum by exposing a large portion of the molten aluminum to the protective atmosphere while the furnace is being fired with the combustion mixture.

In another embodiment, this invention is directed to a process for melting an aluminum charge into molten aluminum and simultaneously refining the molten aluminum to produce a refined molten aluminum having a low hydrogen content which comprises introducing the charge into a direct fired furnace to expose the charge to radiant heat emitted from above the charge; combusting a combustion mixture layer of fuel and oxidant to form a combustion layer which generates the radiant heat and combustion reaction products within the furnace; introducing a hydrogen-free protective atmosphere into the furnace at a vertical distance below the combustion mixture layer; and removing a portion of dissolved hydrogen from the molten aluminum by injecting an inert gas into the molten aluminum while melting the charge and refining the molten aluminum.

The inert gas, such as nitrogen or argon, may be injected into the molten aluminum prior to the complete melting of the charge into molten aluminum. A fluxing gas, such as chlorine, may be added to the inert gas. Also, the protective atmosphere contains less than 1%, and preferably less than 0.1% by volume of a hydrogen containing species.

For purposes of this invention, a "charge" is defined as the aluminum that is to be refined, which may include molten aluminum; a "combustion mixture" is defined as the combustible mixture of an oxidant and fuel which is combusted to generate radiant heat and combustion reaction products within the furnace; and a "protective atmosphere" is defined as a stratum of gas, preferably inert and preferably situated between the charge and the combustion mixture, an example of which is the stratified atmosphere of the '481 patent.

BRIEF DESCRIPTION OF THE DRAWING

FIG. 1 is a simplified cross-sectional representation of one embodiment of an aluminum melting furnace illustrating the method of this invention and the placement of the burner, the injection locations after the furnace has been charged with a large amount of scrap metal materials.

FIG. 2 is a simplified top view representation of the same aluminum melting furnace of FIG. 1.

The numerals in the drawings are the same for the common elements.

DETAILED DESCRIPTION

The invention relates to a process for heating and/or melting a charge of aluminum scrap and/or ingots while providing for a protective atmosphere stratum. The charge is introduced into the furnace and exposed to radiant heat from a direct fired burner placed above the charge. Inert gas is introduced into the molten aluminum bath to agitate the bath and to homogenize the temperature of the bath. The undesirable gases in the molten metal are released by the stripping effect of the inert gas.

The process for refining metal in this invention takes place at the beginning of the process by preventing undesired gases, especially hydrogen, from dissolving into the molten charge. When the charge is heated or melted, the surface of the charge is inerted with an inert gas, like nitrogen or argon, to prevent the reaction of any water vapors or hydrocarbons with the charge to form dissolved hydrogen. Stripping undesired gases while the charge is heated and melted under inert gas will prevent hydrogen containing species from coming in contact with the charge and that an amount of hydrogen dissolved in the charge may be removed.

In one particular embodiment, the process of refining metal in a direct fired furnace further involves the provision of a protective atmosphere, preferably a hydrogen-free protective atmosphere. The protective atmosphere generally contains less than 1% by volume of a hydrogen containing species, and preferably less than 0.1% by volume of a hydrogen containing species. This protective atmosphere may be produced by the stratified atmosphere combustion process as disclosed in the '481 patent. The surface of the charge may be effectively inerted with a gas, preferably an inert gas like nitrogen and argon, to prevent the water or hydrocarbons in the combustion flue gas from reaching the charge to form dissolved hydrogen. When a significant amount of molten charge has been produced and created a molten bath in the bottom of the furnace (still mixed with unmelted solid aluminum pieces), the gas is injected to stir the bath and to strip away any dissolved undesired species, like hydrogen.

The stirring of the bath increases the heat transfer between molten aluminum and the unmelted aluminum solid pieces and accelerates the melting process. As a result, the temperature of the aluminum charge is homogenized to a greater extent by the agitation caused by the inert gas. It also reduces the surface temperature of the molten aluminum bath and hence increases the radiative heat transfer from the combustion space of the furnace to the bath surface.

The protective atmosphere is introduced below the combustion mixture combusted by the direct fired burner to substantially shields the charge from the normal furnace atmosphere which includes combustion gases resulting from the direct fired burner.

The protective atmosphere within a direct fired furnace provides certain beneficial results in heating the aluminum charge. A protective atmosphere is created between the direct fired burner in the furnace and the charge, thus substantially shielding the charge from the furnace combustion products.

The protective atmosphere and combustion mixture may mix with each other to some extent. Accordingly, the two need not be, and usually will not be, entirely distinct. Nevertheless, as a result of introducing the protective atmosphere, oxidation of the charge material can be controlled in a manner substantially independent of the composition and oxidative properties of the combustion stratum. A furnace containing such a protective atmosphere substantially retains the advantages of a direct fired furnace (e.g., high heat transfer rate and low costs) but allows control of the atmosphere to which the charge is exposed.

Where it is desired to reduce oxidation of the charge, the composition of the protective atmosphere is chosen to be substantially inert (or reductive) with respect to the charge. Nitrogen can be advantageous in this embodiment because of its low cost and low environmental impact. Argon, however, may better protect the charge from oxidation because it is heavier than air and thus less likely to mix with the burner combustion products.

After a substantial amount of charge have been melted, the resulting bath is allowed to continue stirring, partly by the injection of the inert gases. The undesired volatile species continues to be removed under the protective atmosphere.

Stirring the bath increases the heat transfer between the molten charge and unmelted charge pieces, and accelerates the melting process. This also reduces the surface temperature of the molten charge bath and therefore increases the radiative heat transfer from the combustion area of the furnace to the surface of the molten charge bath.

It should be noted that the inert gas used to inject into the molten bath of the charge may be the same or different from the gas for the inert or reducing protective atmosphere. As a result, the introduction of the inert gas homogenizes the temperature of the charge.

In one particularly desired embodiment, the gas used to inject directly into the molten charge may contain a fluxing gas, such as chlorine, mixed with the inert gas. While injecting the inert gas into the molten charge, other undesired materials such as alkali metals and other impurities may be removed at the same time. Certain elements for alloying the charge may also be added, optionally under inert gas stirring, after fluxing. An aspect of this invention is that the melting of the charge, the removal of undesired material, and the addition of any material for alloying the charge may be performed while the charge is being heated to a desired tap temperature for casting or for further processing. The simultaneous process for melting and refining significantly improves the productivity of the furnace operations.

In general, it is advantageous to minimize mixing of the uncontrolled atmosphere from the combustion mixture with the protective atmosphere. This means largely avoiding mixing of the combustion products from the directly fired burner into the protective atmosphere.

A variety of configurations of burner, protective atmosphere gas inlet, and flue port will be apparent to one skilled in the art in light of the present invention.

It is also possible, instead or in addition, to inject the gas of the protective atmosphere through the charge, using tuyeres, once the charge has become molten. For example, an inert gas such as argon might be bubbled through molten aluminum, in order to reduce exposure to oxidizing gases.

In general, the size and shape of the furnace is important in determining the flows that are used. A tall furnace is generally easier to stratify. Thus, while a flow ratio of gas of the protective atmosphere: natural gas of 1.0 might be appropriate in a tall furnace, a higher ratio of e.g., 3.0, might be appropriate in a shorter furnace.

The furnace can be operated at normal temperatures that are required for heating of aluminum charges with proper refractory material selection. It is believed that the combustion mixture of fuel and oxidant can be operated up to a temperature of roughly 3500° F. while realizing advantages of the invention.

The process of this invention may be effectively integrated with an air separation system wherein a feed stream comprising nitrogen and oxygen is separated into fluids richer respectively in nitrogen and oxygen than is the feed stream. For example, a nitrogen-rich stream from a pressure swing adsorption separation plant or a membrane separation plant may be used as the gas of the protective atmosphere, while the oxygen-richer stream from the plant may be used as the oxidant for the burner.

EXAMPLE

An example of the apparatus used in this invention is found in the drawings. FIG. 1 provides for a side elevation view of a furnace 10, with a burner 25 on one side of the furnace. A flue port 15 is located on top and a blanket gas jet injector 20 is provided on either side of the furnace. The maximum height of the molten bath when the charge is fully melted in the furnace is the metal line 30, which may be about 28" from the furnace floor. The highest point 40 of the furnace below the dome 45 of the furnace to the furnace floor is about 87".

FIG. 2 is an overhead view of the interior of the furnace showing the location of the flue 15 and the location of the door 50. In one embodiment, the diameter of the interior of the furnace is about 5.5'.

During a typical process of heating and melting the aluminum charges, scrap aluminum and ingots are charged to the furnace. There may be a pool of molten aluminum left from the previous melting cycle in the bottom of the furnace. In some cases, hot molten aluminum metal may be charged as well.

Other embodiments of the apparatus may be optimized in different situations, which are appreciated by those skilled in the art. For example, in a side well charged furnace, there are two compartments, a side well to charge and melt aluminum scrap, and a directly fired combustion chamber. In this type of furnace, molten aluminum is super heated in the combustion chamber and circulated to the side well. Aluminum scrap is submerged into the super heated molten aluminum and melted. The present invention may be practiced in the combustion chamber in this case.

In the present invention, a mixture of fuel and oxidant, either premixed or post mixed, is injected into the furnace to form a combustion layer which generates radiant heat and combustion reaction products in the furnace. When a significant amount of molten aluminum has been produced and a molten bath is created in the bottom of the furnace and mixed with unmelted solid aluminum pieces by exposure to the radiant heat of the combustion, an inert gas is injected to stir the bath and to strip any dissolved hydrogen. A hydrogen free protective atmosphere is introduced between the combustion mixture layer and the charge. Stirring the bath increases the heat transfer between molten aluminum and the unmelted aluminum solid pieces and accelerates the melting process. It also reduces the surface temperature of the molten aluminum bath, and hence increases the radiative heat transfer from the combustion space of the furnace to the bath surface. After all submerged aluminum solid pieces have been melted, the bath is continued to be stirred and stripped of hydrogen to a desired concentration. Portions of the hydrogen containing species may be removed. Various fluxing gases such as chlorine may be mixed with the inert gas and injected into the bath to remove alkali metals and other impurities at the same time or after stirring and melting. Alloying elements such as magnesium may be added to the bath after the fluxing operation. All of the above can be done while the bath is being heated to the desired tap temperature for casting or for further processing. The simultaneous melting and refining process has been shown to improve the furnace productivity significantly. Such improvement can be shown by the decrease in total cycle time for the simultaneous melting and refining practice as compared to the conventional melting and refining practice as provided in the following Table I.

TABLE I

| Procedure | Approx. Time in Conventional melting/refining | Approx. Time in Simultaneous melting/refining |
|---|---|---|
| Furnace charging | 30 min. | 30 min. |
| Start firing and melting to flat bath | 90 min. | 90 min. |
| Complete melting under flat bath and increase bath temperature to 1400° F. | 30 min. | 30 min. |
| Dross skimming | 20 min. | — |
| Simultaneous gas injection and fluxing | (na) | — |
| Chlorine fluxing | 20 min. | — |
| Dross skimming | 20 min. | 20 min. |
| Tapping or transfer hot metal to holding furnace | 30 min. | 30 min. |
| Total cycle time | 240 min. | 200 min. |

The overall cycle time is reduced by approximately 40 minutes, which is equivalent to about 17% production rate increase using the simultaneous melting and refining process of the present invention.

The furnace is a 4,000 lb (1,800 kg) round top with an inside diameter of 5.5 ft (1.7 m) and an internal height of about 7.25 ft (2.2 m). Schematics of the furnace and burner are shown FIGS. 1 and 2. Four blanket gas injectors were installed above the molten metal bath. Three oxy-fuel burners were installed in the side wall.

The test procedures achieved good quantitative analysis of dross formed during melting. The range of charge material densities encountered in commercial applications was bracketed by using various combinations of scalper chips and 1,000 lb to 1,500 lb (500 kg to 700 kg) sows. Each charge weight for the tests varied by ±5%. Each charge was melted back to back around the clock for consistency of furnace preheat. The furnace lid was removed to charge the chips, and the ingots were placed on top. The amount of chips ranged from 5% to 25% of the total charge. The burners were maintained at low fire during the charging operation. Once the furnace lid was replaced, the burners were immediately brought to the high firing rate. As the melt loss is a function of melt time, comparisons were only drawn between different melting techniques performed with similar melt times. The firing rates of the oxy-fuel burners ranged from 2.1 to 3.5 MMBTU/hr (530 to $880\times10^6$ cal/hr). A separate high velocity air burner was used to establish the baseline. The firing rates for the air firing tests ranged from 2.8 to 4.0 MMBTU/hr (710 to $1100\times10^6$ cal/hr).

High firing was maintained at a constant rate until the bottom of the bath reached about 1390° F. At that point the firing rate was reduced or the firing was stopped, and the bath was skimmed.

Melt skim was manually raked from the top of the molten bath, and drained using consistent practices. The bath was then sampled for metal chemistry and hydrogen analysis. The skim was not fluxed to ensure more reproducible results.

To return the metal to its original condition for use in other tests, it was then fluxed with a gas mixture of 90% argon and 10% chlorine to remove suspended dross. Magnesium was then added to maintain the magnesium content at approximately 4.7% and the bath was then stirred and skimmed again. The bath temperature before tapping was recorded. After a series of consecutive heats under similar conditions, the furnace was scraped hot and the bottom skim was also weighed and attributed to the heats of those preceding series. Ingots were cooled to room temperature before being used again.

The results of the following four runs are summarized in the following Table II and show the benefits of the present invention.

TABLE II

| Run Number | $H_2$ concentration | Melt Skim |
|---|---|---|
| A (CAM, $N_2$) | 0.28 ppm | 0.90% |
| B (CAM, $N_2$, Ar stirring) | 0.18 ppm | 1.50% |
| C (CAM, $N_2$, Ar stirring and flux) | 0.14 ppm | 1.83% |
| D Air baseline | 0.52 ppm | 4.54% |

Run Number D is the baseline with conventional high velocity air burner firing. Melt skim was 4.54% of the charge weight and the hydrogen content of the molten aluminum was 0.52 ppm.

In Run A, the controlled atmosphere melting (CAM) process described in the '903 patent was used during the melting and the melt skim was reduced to 0.90% of the charge (80% reduction over the baseline) and the hydrogen content of the molten aluminum was reduced to 0.28 ppm. This large reduction (46% reduction over the baseline) is considered to be caused by preventing water vapor in the combustion products to come in contact with molten aluminum. Such a large reduction in hydrogen content was completely unexpected. A possible explanation for such a large reduction in hydrogen content is the creation of a large molten aluminum surface areas during melting and exposure to the inert gas atmosphere. During melting of a high pile of aluminum charge, molten aluminum droplets and streams cascade down the scrap pile, resulting in the intimate contact of molten aluminum surfaces and the inert atmosphere. Some of dissolved hydrogen may be stripped out during such a dynamic melting process.

In Run B the CAM process described in the '903 patent was used during the melting. When the flat bath condition was reached, the aluminum bath was stirred by introducing about 1 SCFM of argon gas through a graphite lance to stir the melt. The melt skim was reduced to 1.5% of the charge (66% reduction over the baseline) is considered to be caused by stripping of dissolved hydrogen by stirring action of argon. Such a large reduction in hydrogen content was unexpected as the injection of argon was gentle and only large bubbles were produced from the lance.

In Run C, the CAM process described in the '903 patent was used during the melting. When the flat bath condition was reached, the aluminum bath was stirred by introducing about 1 SCFM of argon gas containing about 10% chlorine gas through a graphite lance to stir the melt. The melt skim was reduced to 1.83% of the charge (60% reduction over the baseline) and the hydrogen content of the molten aluminum was further reduced to 0.14 ppm. This large reduction (73% reduction over the baseline) is considered to be caused by more effective stripping of dissolved hydrogen when fluxing gas is mixed with argon.

Refining aluminum having a hydrogen concentration of as low as 0.14 ppm was achieved under a simultaneous CAM melting/fluxing with a rather crude method. Other alternative embodiments may include different methods for injecting inert gas into the molten bath, production of well dispersed small inert gas bubbles for effective stripping, use of porous or special nozzles with multiple holes attached to the lance to facilitate the creation of small bubbles, use of multiple lances to widely distribute the small bubbles. Also, lower hydrogen values are expected by injecting inert gas through porous plugs.

Specific features of the invention are shown in one or more of the drawings for convenience only, as each feature may be combined with other features in accordance with the invention. Alternative embodiments will be recognized by those skilled in the art and are intended to be included within the scope of the claims.

What is claimed is:

1. A process for producing molten aluminum having a low hydrogen content which comprises:

A) introducing an aluminum charge into a direct fired furnace to expose said charge to radiant heat emitted from above said charge;

B) combusting a combustion mixture layer of fuel and oxidant to form a combustion layer which generates said radiant heat and combustion reaction products within said furnace; and C) introducing a substantially hydrogen-free protective atmosphere into said furnace at a vertical distance below said combustion mixture layer.

2. The process of claim 1 which further comprises removing a portion of a dissolved hydrogen-containing species from said molten aluminum by exposing a large portion of said molten aluminum to said protective atmosphere while said furnace is being fired with said combustion mixture.

3. The process of claim 1 wherein said protective atmosphere contains less than 1% by volume of a hydrogen containing species.

4. The process of claim 3 wherein said protective atmosphere contains less than 0.1% by volume of a hydrogen containing species.

5. A process for melting an aluminum charge into molten aluminum and refining said molten aluminum to produce a refined molten aluminum having a low hydrogen content which comprises:

A) introducing said charge into a direct fired furnace to expose said charge to radiant heat emitted from above said charge;

B) combusting a combustion mixture layer of fuel and oxidant to form a combustion layer which generates said radiant heat and combustion reaction products within said furnace;

C) introducing a substantially hydrogen-free protective atmosphere into said furnace at a vertical distance below said combustion mixture layer; and D) removing a portion of dissolved hydrogen from said molten aluminum by injecting an inert gas into said molten aluminum while melting said charge and refining said molten aluminum.

6. The process of claim 5 wherein said inert gas is injected into the molten aluminum prior to the complete melting of said charge into molten aluminum.

7. The process of claim 5 wherein said inert gas is a nitrogen or argon.

8. The process of claim 5 wherein a fluxing gas is added to said inert gas.

9. The process of claim 8 wherein said fluxing gas is chlorine.

10. The process of claim 5 wherein said protective atmosphere contains less than 1% by volume of a hydrogen containing species.

11. The process of claim 10 wherein said protective atmosphere contains less than 0.1% by volume of a hydrogen containing species.

* * * * *